US005511960A

United States Patent [19]

Terakawa et al.

[11] Patent Number: 5,511,960

[45] Date of Patent: Apr. 30, 1996

[54] SPINNERET DEVICE FOR CONJUGATE MELT-BLOW SPINNING

[75] Inventors: Taiju Terakawa; Sadaaki Nakajima, both of Shiga, Japan

[73] Assignee: Chisso Corp., Ohsaka, Japan

[21] Appl. No.: 32,325

[22] Filed: Mar. 17, 1993

[30] Foreign Application Priority Data

Mar. 17, 1992 [JP] Japan ..... 4-060512

[51] Int. Cl.[6] ..... D01D 04/06; D01D 05/12; D01D 05/32

[52] U.S. Cl. ..... 425/7; 264/12; 264/172.14; 264/210.8; 264/DIG. 28; 264/DIG. 29; 425/66; 425/72.2; 425/131.5; 425/382.2; 425/463; 425/DIG. 217

[58] Field of Search ..... 425/7, 66, 72.2, 425/131.5, 462, 463, 382, DIG. 217; 264/12, 171, 177.13, 210.8, DIG. 24, DIG. 28

[56] References Cited

U.S. PATENT DOCUMENTS

| | | | |
|---|---|---|---|
| 3,174,184 | 3/1965 | Calaway | 425/382.2 |
| 3,176,346 | 4/1965 | Brazelton | 425/131.5 |
| 3,403,422 | 10/1968 | Nakagawa et al. | 425/131.5 |
| 3,480,996 | 12/1969 | Matsui | 425/131.5 |
| 3,540,077 | 11/1970 | Nakagawa et al. | 425/131.5 |
| 3,585,685 | 6/1971 | McDermott | 425/DIG. 217 |
| 3,792,944 | 2/1974 | Chimura et al. | 425/131.5 |
| 3,849,241 | 11/1974 | Butin et al. | 428/137 |
| 3,981,650 | 9/1976 | Page | 425/131.5 |
| 4,547,420 | 10/1985 | Krueger et al. | 428/229 |
| 4,738,607 | 4/1988 | Nakajima et al. | 425/131.5 |
| 5,017,116 | 5/1991 | Carter et al. | 425/131.5 |
| 5,190,812 | 3/1993 | Joseph et al. | 428/297 |

FOREIGN PATENT DOCUMENTS

| | | | |
|---|---|---|---|
| 138556 | 4/1985 | European Pat. Off. . | |
| 138549 | 4/1985 | European Pat. Off. . | |
| 43-16654 | 7/1968 | Japan | 425/131.5 |
| 47-29441 | 8/1972 | Japan | 425/131.5 |
| 50-46972 | 4/1975 | Japan . | |
| 54-134177 | 10/1979 | Japan . | |
| 60-99058 | 6/1985 | Japan . | |
| 60-99057 | 6/1985 | Japan . | |
| 2-289107 | 11/1990 | Japan . | |

OTHER PUBLICATIONS

Patent Abstracts of Japan, JP–A–2289107, vol. 15, No. 60, Feb., 1991.

"Superfine Thermoplastic Fibers", Industrial And Engineering Chemistry, vol. 48, No. 8, Aug. 1956, pp. 1342–1346.

*Primary Examiner*—Jay H. Woo
*Assistant Examiner*—Joseph Leyson
*Attorney, Agent, or Firm*—Fay, Sharpe, Beall, Fagan, Minnich & McKee

[57] ABSTRACT

A spinneret device for side-by-side, conjugate melt-blow spinning can correspond to combinations of various heterogeneous polymers for conjugate spinning and is uniform in the conjugate state such as conjugate ratio between single fibers, the proportion of the peripheral percentage of both the components in the fiber cross-section, etc. and has fineness, a large nozzle plate width and a superior productivity. The device is composed mainly of a spinning resin-feeding plate; a distributing plate; a separating plate provided with confluent grooves of conjugate components engraved at the bottom part of the plate, corresponding in number to the spinning nozzles; a nozzle plate; and a plate for controlling the clearance for a gas. Even when the viscosity unevenness, spinning temperature unevenness, etc. of the spinning resins occur in the cavity of the nozzle plate to some extent, microfine fibers can be obtained which are uniform in the composite ratio and the cross-sectional, peripheral percentages of the respective components in the fiber cross-section, while being uniformly fine.

3 Claims, 8 Drawing Sheets

SPINNERET DEVICE FOR CONJUGATE MELT-BLOW SPINNING

BACKGROUND OF THE INVENTION

1. Field of the Invention

This invention relates to a spinneret device for conjugate melt-blow spinning. More particularly it relates to a spinneret device for side-be-side type conjugate melt-blow spinning wherein two kinds of spinning dopes are melt-extruded from spinning nozzles to form side-by-side conjugate fibers, followed by blow-spinning the extruded unstretched fibers by means of a high speed gas current. Microfine fibers obtained by means of such a spinning device are processed into a web-form product, a non-woven fabric or a molded product and used for a mask, a filter for precision filtration, a battery separator, a hygienic material, a thermal insulant, etc.

2. Description of the Prior Art

The so-called melt-blow spinning wherein a thermoplastic synthetic resin is melt-extruded from spinning nozzles followed by spouting a high temperature gas at a high speed from clearances provided on both sides of the spinning nozzles onto the extruded unstretched fibers to effect blow-spinning, makes it possible to obtain microfine fibers such as those having a fiber diameter of 10 μm or less. Since spinning of fibers and production of a non-woven fabric are carried out successively, the above process is advantageous for producing a non-woven fabric of microfine fibers.

There are two ways for melt-blow spinning, one of which is by means of non-conjugate fibers and the other is by means of conjugate fibers.

As to the melt-blow spinning of non-conjugate fibers, a device and spinning process are disclosed in Industrial and Engineering Chemistry, Vol. 48, No. 8, pp 1342–1346, 1956. Japanese patent application laid-open No. Sho 50-46972 and Japanese patent application laid-open No. Sho 54-134177 disclose a process wherein spinning is carried out while decomposing a polymer or while keeping the spinning conditions such as the apparent viscosity, extrusion temperature, etc. of a polymer within specified critical ranges, along with an apparatus therefor. However, the above-mentioned references do not disclose any spinning of conjugate fibers.

As to the so-called conjugate melt-blow spinning directed to conjugate fibers, Japanese patent application laid-open No. Sho 60-99057 and Japanese patent application laid-open No. Sho 60-99058 disclose a spinneret device for side-by-side conjugate melt-blow spinning, provided with conduits for introducing two kinds of polymers from the respective extruders therefor, into holes for combining conjugate components of the polymers, spinning nozzles and an air-orifice, and a spinning process. According to these publications, it has been regarded as possible to produce microfine fibers according to a side-by-side type conjugate, melt-blow spinning process, even in combinations of herterogeneous polymers such as polyester/polypropylene, nylon 6/polypropylene, etc. as conjugate components.

In the spinneret device and the production process of conjugate fibers disclosed in the above two publications, it has been regarded that viscosities of heterogeneous polymers passing through the die should be generally similar, and can be achieved by controlling the temperature and retention time inside the extruder, the composition of the polymer, etc. Namely, in the production process, only when the heterogeneous polymers reach the spinning nozzles in a state where the respective extrusion temperatures and retention times have been controlled so that the respective viscosities have become almost equal, and also when they flow through the inside of the spinneret while retaining the balance between the respective viscosities, the polymers can form a conjugate mass which is then extruded through nozzles of the spinneret without any notable turbulence or break at the conjugate portions to form conjugate blow fibers. However, according to such a spinneret device, it is possible to obtain uniform conjugate melt-blown fibers only when the temperature and retention time inside the extruder and the composition of the polymers, etc. are controlled precisely while employing a relatively small spinneret having a short retention time, without taking productivity into consideration.

Namely, when a commercial spinneret device is taken into consideration, the following problems occur. When a viscosity difference has occurred between the respective melted polymers due to the variation in the molecular weights of the polymers themselves, accompanied by a slight variation in the extrusion temperatures, then turbulence of flow of the polymers melted inside the spinneret device occurs, making it impossible to obtain a uniform conjugate mass inside the cavity of the spinneret device. Hence it is impossible to form uniform, conjugate blow fibers.

Further, even if the temperature inside the extruder has been precisely controlled so as to maintain the viscosities of the polymers at definite values, when a large spinneret is used for productivity, polymers having different fluidities flow through the spinneret kept at the same temperature, so that the retention time inside the spinneret device is prolonged and hence the viscosity balance is broken due to the difference of fluidities of the polymers making it impossible to form uniform, conjugate blown fibers, and the uneven fineness of the resulting fibers increases.

Japanese patent application laid-open No. Hei 2-289107 disclosed a side-by-side type, conjugate, melt-blow spinneret device provided with a slender groove-form, confluent resin flow-controlling part having a defined ratio of length to thickness in the length direction of the spinneret, engraved at the bottom part of the nozzle plate 5 in the length direction, nozzle plate 5 having spinning holes 15 engraved at the above bottom part, and separating plates 4 for separating two kinds of melted resins, provided in the cavity of the device (see FIGS. 17 and 18). Further, the above publication also discloses a spinneret having a circular pipe part 25 for inserting a mixer into the bottom of the confluent resin flow-controlling part 23 (see FIG. 19). According to the device, the engraved, confluent resin flow-controlling part has the defined ratio of length to thickness in the length direction of the spinneret; therefore, even when spinning melted resins having viscosities that are somewhat different from each other are used as the first component and the second component of the conjugate fibers, the conjugate ratio, the fineness consistency, etc. are somewhat improved, as compared with the prior art of the above publications, but since any mechanism for a uniform confluence of conjugate components and for a uniform distribution of these components corresponding to the respective spinning nozzles are not provided, the above-mentioned problems have not yet been solved.

As described above, in any of the above prior art, no consideration has been taken about a uniform confluence mechanism and a uniform distribution mechanism of conjugate components directed to all of the individual spinning nozzles.

SUMMARY OF THE INVENTION

The object of the present invention is to provide a spinneret device for side-by-side, conjugate melt-blow spinning, which can correspond to combinations of various kinds of heterogeneous polymers and yet be uniform in the conjugate state such as a conjugate ratio between extruded single fibers a proportion of peripheral percentages of both the components in the fiber cross-section, etc. and also be uniform in the fineness of the fiber. Another object of the present invention is to provide a spinneret device which does not require an exchange of nozzle plates even in the case of combinations of polymers inferior in the conjugate state, and can obtain fibers having a good conjugate state and a uniform fineness from various kinds of polymers only by exchange of a separating plate which price is low. Still another object is to provide a spinneret device having a large width of spinneret and a superior productivity.

The present invention has the following constitutions:

(1) A spinneret device for side-by-side conjugate melt-blow spinning, provided with a spinning resin-feeding plate 2 having spinning resin-introducing grooves for introducing two kinds of spinning resins into distributing grooves of a distributing plate 3, respectively engraved therein; the distributing plate 3 having distributing grooves for distributing the spinning resins fed from the spinning resin-feeding plate 2; a nozzle plate 5 having a cavity 13 for receiving a separating plate 4, engraved on the back surface thereof, and also having holes 14 for introducing a conjugate component and spinning nozzles 15 bored successively on the bottom surface X of the cavity 13 thereof; a separating plate 4 having its bottom part engraved so that confluent grooves 17 for combining the above-mentioned different spinning resins may intersect the length direction of the grooves, wherein the confluent grooves 17 may be positioned on the central axis of the spinning nozzles 15; and a clearance for spouting a gas, provided around the nozzle plate 5 and toward the exit of the spinning nozzles 15.

2. A spinneret device for side-by-side, conjugate melt-blow spinning according to item 1, wherein the distributing grooves of the distributing plate 3 are engraved in the length direction of the back surface of the distributing plate 3; distributing holes, for leading the spinning resins into grooves 13 for receiving the spinning resins, of the nozzle plate 5 are bored in the distributing grooves; partitioning walls are formed between the respective confluent grooves 17 of the separating plate 4; and the clearance for spouting a gas is formed between the nozzle plate 5 and a plate 6 for controlling the clearance for a gas, provided around the nozzle plate 5.

3. A spinneret device for side-by-side conjugate melt-blow spinning according to item 1 or item 2, wherein the bottom surface K of the walls for partitioning the confluent grooves of the separating plate 4 is closely contacted to the bottom surface X of the cavity of the nozzle plate 5.

4. A spinneret device for side-by-side conjugate melt-blow spinning according to item 1 or item 2, wherein a narrow clearance $D_1$ is provided between the bottom surface K of the walls for partitioning the confluent grooves of the separating plate 4 and the bottom surface X of the cavity of the nozzle plate 5 and $D_1$ is smaller than the width $W_3$ of the grooves 12 for controlling the pressure of the spinning resins.

5. A spinneret device for side-by-side conjugate melt-blow spinning according to item 1 or item 2, wherein a narrow clearance $D_1$ is provided between the bottom surface K of the walls for partitioning the confluent grooves of the separating plate 4 and the bottom surface X of the cavity of the nozzle plate, and $D_1$ is smaller than either of the width $W_3$ of the grooves 12 for controlling the pressure of the spinning resins or the depth $D_2$ of the grooves 17.

6. A spinneret device for side-by-side conjugate melt-blow spinning according to item 5, wherein the depth $D_2$ of the grooves of the separating plate 4 is smaller than the width $W_3$ of the grooves 12 for controlling the pressure of the spinning resins.

BRIEF DESCRIPTION OF THE DRAWINGS OF THE INVENTION

Figure 3:
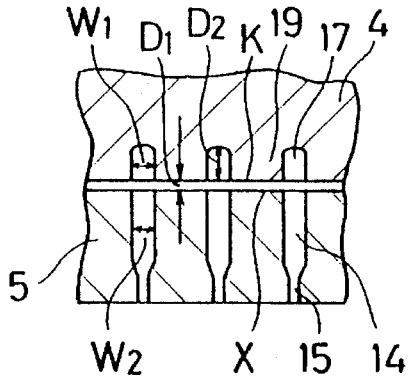
Figure 4:
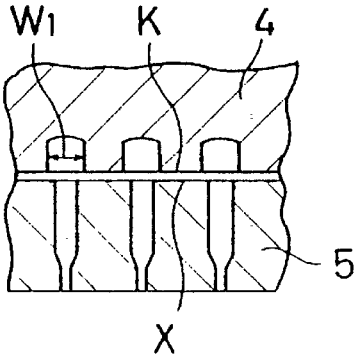

FIGS. 3 and 4 each show enlarged, cross-sectional views of the side surface of the separating plate for illustrating the grooves for combining different dopes.

Figure 5:
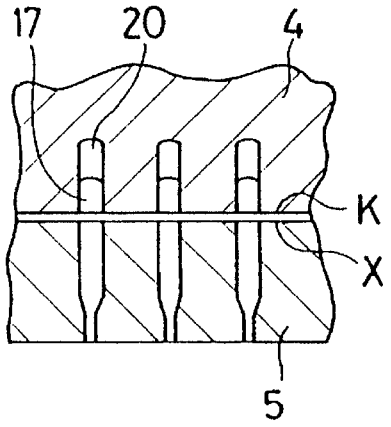
Figure 6:
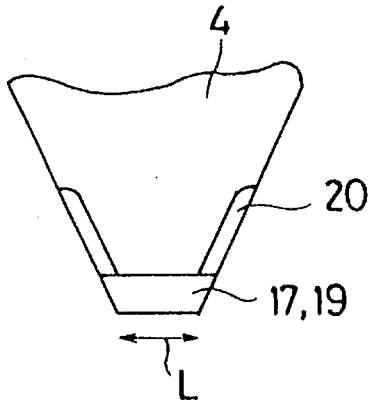

FIGS. 5 and 6 each show an enlarged, cross-sectional view of the separating plate for illustrating the confluent grooves having introducing grooves.

Figure 7:
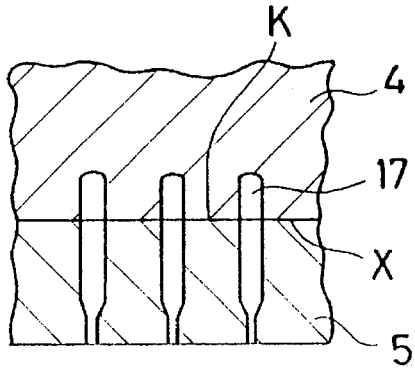
Figure 8:
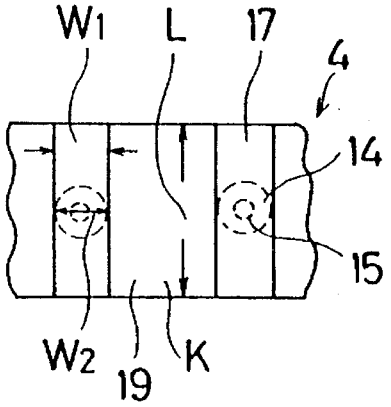
Figure 9:
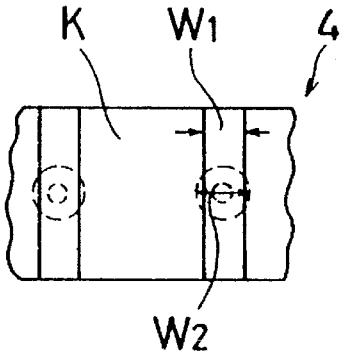
Figure 10:
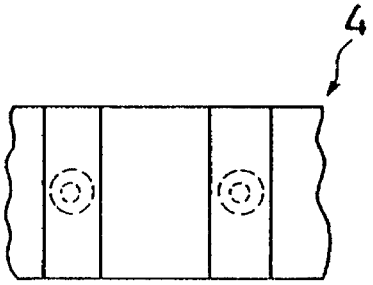

FIG. 7 shows an enlarged, cross-sectional side view of the side surface of the separation plate for illustrating the confluent grooves.

FIGS. 8, 9, 10, 11, 12 and 13 each show a view for illustrating the relationship between the confluent grooves and the conjugate component-introducing hole.

Figure 14:
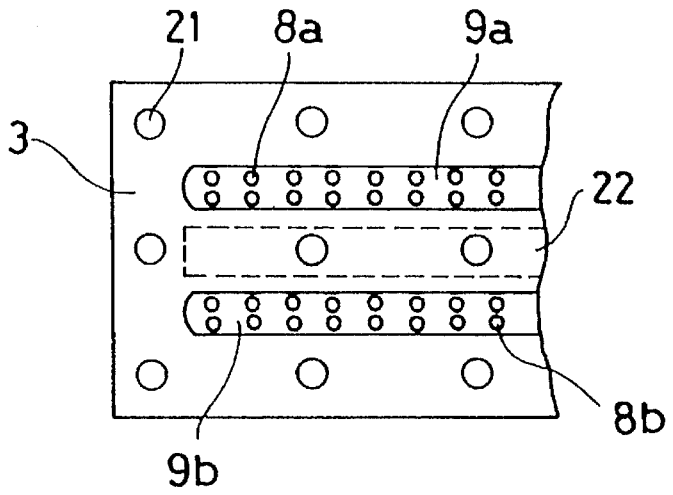

FIG. 14 shows a view of the plane-back surface of the distributing plate.

Figure 15:
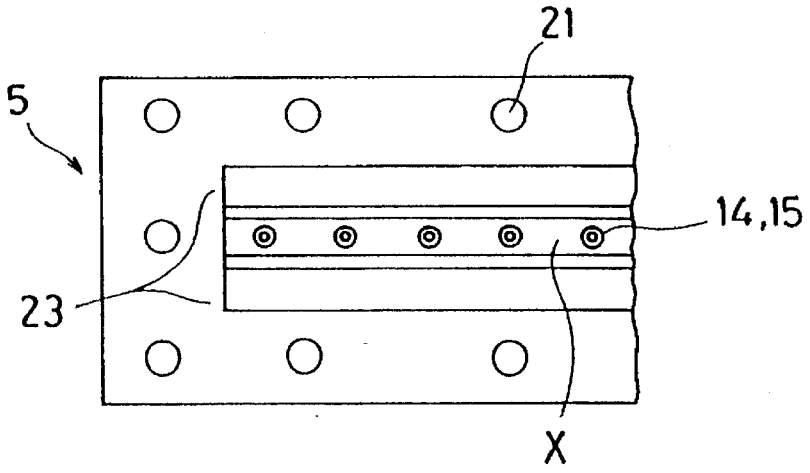

FIG. 15 shows a view of the plane-back surface of the nozzle plate.

Figure 16A:
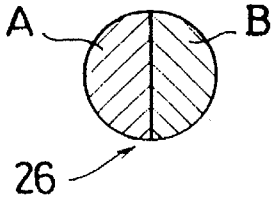
Figure 16B:
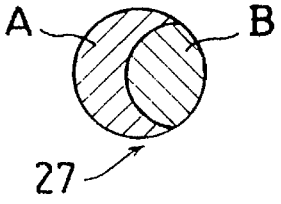

FIGS 16(*a*) and 16(*b*) show a cross sectional view of fibers.

Figure 17:
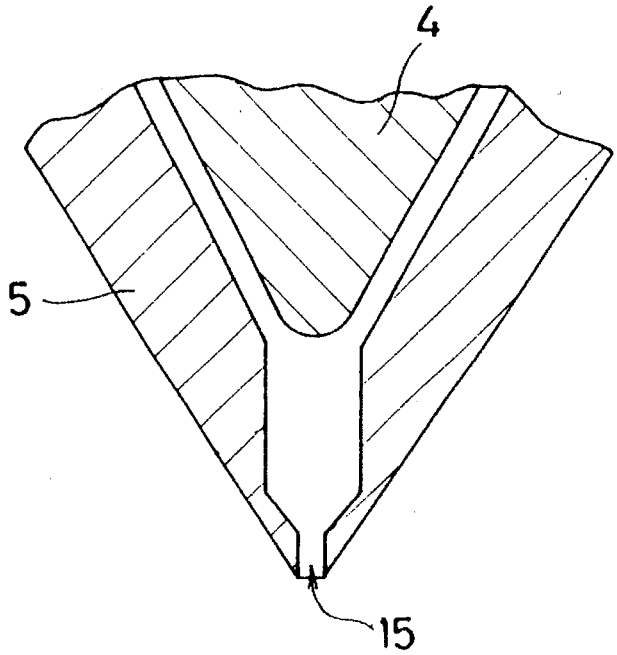
FIG. 17 (PRIOR ART)

FIG. 17 shows a front, cross-sectional, schematic view of a conventional spinneret device for conjugate melt-blow spinning.

Figure 18:
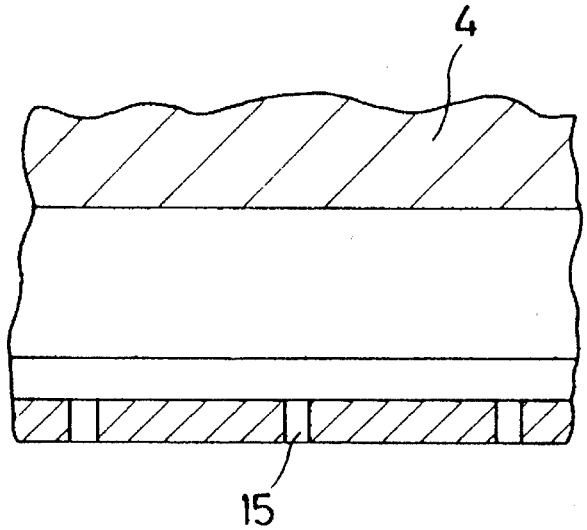
FIG. 18 (PRIOR ART)

FIG. 18 shows a side, cross-sectional, schematic view of a conventional spinneret device for conjugate melt-blow spinning.

Figure 19:
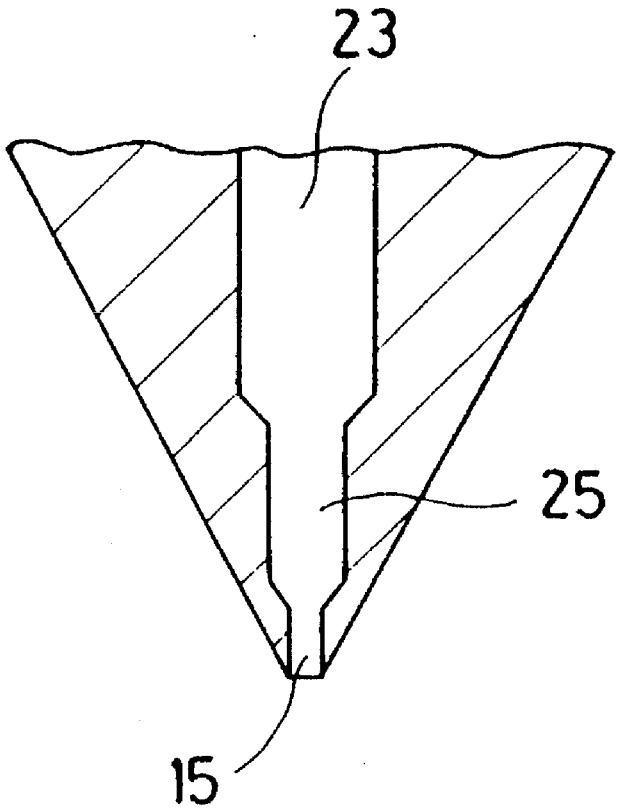
FIG. 19 (PRIOR ART)

FIG. 19 shows a front, cross-sectional, schematic view of a conventional spinneret device for conjugate melt-blow spinning, having a circular pipe part.

DESCRIPTION OF PREFERRED EMBODIMENTS

The embodiments of the present invention will be described below referring to the accompanying drawings.

This spinneret device 1 illustrated in FIGS. 1 and 2 mainly composed of a plate 2 for feeding spinning melted resin A and B, having grooves 7*a* and 7*b* for introducing the resins, respectively, engraved therein; a distributing plate 3 for uniformly distributing the resins fed via the plate 2; a nozzle plate 5 having a cavity 13 for inserting a separating plate 4 mentioned below, engraved on the back surface thereof, and also having holes 14 for introducing conjugate components and a spinning nozzle 15 bored on the bottom surface X of the cavity 13; a separating plate 4 engraved so that, at the lower part of the plate, confluent groove 17 for confluently combining the above spinning resins can intersect the length direction, the confluent groove 17 being present on the central axis of the spinning nozzle 15; and a clearance 16 for spouting a gas, formed toward the exit of the spinning nozzle 15, between the nozzle plate 5 and a plate 6 for controlling the clearance 16 for spouting a gas, provided outside the plate 5.

The plate 2 for feeding the spinning melted resin has grooves 7*a* and 7*b* for introducing the dope engraved in a slit form, and the discharge ports thereof are engraved in a broad angle form so as to accord with the distributing grooves 9*a* and 9*b* of the distributing plate 3. The plate 2 for feeding the spinning resin may be of one member, but in the case of the instant embodiment, the plate is divided into three members: a left member, a central member and a right member as shown in FIG. 1, which are respectively fixed by bolts. The distributing plate 3 has distributing grooves 9*a* and 9*b* engraved in the length direction, that is, in the front and rear directions as viewed in FIG. 1. Further, at the respective bottoms thereof, a number of distributing holes 8*a* and 8*b* are bored.

The distributing grooves 9*a* and 9*b* have filters 10 fitted therewith, and the bottoms of the distributing grooves also function as a support of the filters. The filters 10 may be provided either on the central surface of the spinning resin-discharging part of the distributing holes 8*a* and 8*b* or on the spinning resin-receiving port of the plate 2. Although the distributing plate 3 and a separating plate 4 mentioned below are fixed by bolt 11*a* disposed in a bolt hole 21*a* that passes through plate 3 and part way into plate 4, they may be of a solid structure. A bolt 11*b* is provided, which is also shown in FIG. 1, that passes through a hole 21*b* extending through nozzle plate 5, distributing plate 3 and part way into plate 2, for fixing the plates together.

The cavity of the nozzle plate 5 is separated into two parts (right and left parts as viewed in FIG. 2) by the separating plate 4 arranged in the cavity, to form the spinning resin-receiving grooves 13 of two parts (see FIG. 1) and two narrow grooves 12 for controlling the pressure of the spinning resins, communicating with the grooves 13.

The upper surface of the nozzle plate 5 has a cavity for receiving a separating plate 4, engraved in the length direction, that is, in the front and rear directions as viewed in the figure, and the bottom surface X of the cavity bottom has conjugate component-introducing holes 14 and spinning nozzles 15 at the lower part of the holes 14.

In the above construction, the respective spinning melted resins of the component A and B extruded from two extruders reach the respective ports of the spinning melted resin-receiving parts (now shown) by means of two gear pumps (not shown), and are discharged into the respective spinning resin-introducing grooves 7*a* and 7*b* and reach the distributing grooves 9*a* and 9*b* of the distributing plate 3. The respective spinning resins pass through the respective distributing holes 8*a* and 8*b* and are discharged into the grooves 13 for receiving the spinning resins of the upper part of the nozzle plate 5. The respective spinning resins pass through the respective spinning resin-receiving grooves 13 and the grooves 12 for controlling the pressure of the spinning resins, and are combined in a confluent groove 17 at the lower part of the separating plate 4, followed by passing through the conjugate component-introducing hole 14 of the nozzle plate 5 and being spun through the spinning nozzle 15.

The bottom surface X of cavity of the nozzle plate 5 is contacted closely to the bottom surface K of the confluent groove-partitioning walls of the separating plate 4 mentioned below, as shown in FIG. 7, or both the surfaces are not contacted, but a narrow clearance $D_1$ is formed therebetween, as shown in FIG. 3. Further, when the nozzle plate 5 is cut so as to perpendicularly intersect its length direction, the resulting shape takes an inverted, equilateral triangle.

Figure 1:
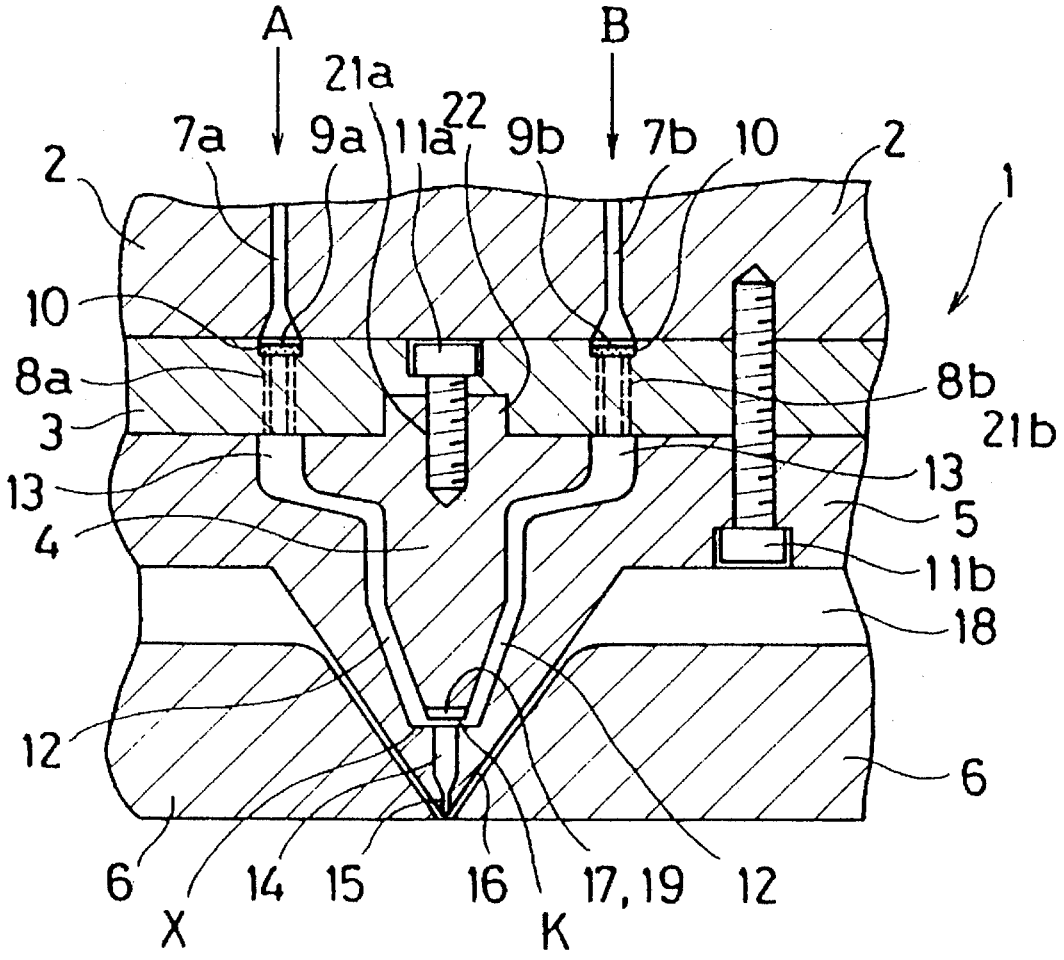
FIG. 1 shows a front, schematic, cross-sectional view of the spinneret device for conjugate melt-blow spinning.
Figure 2:
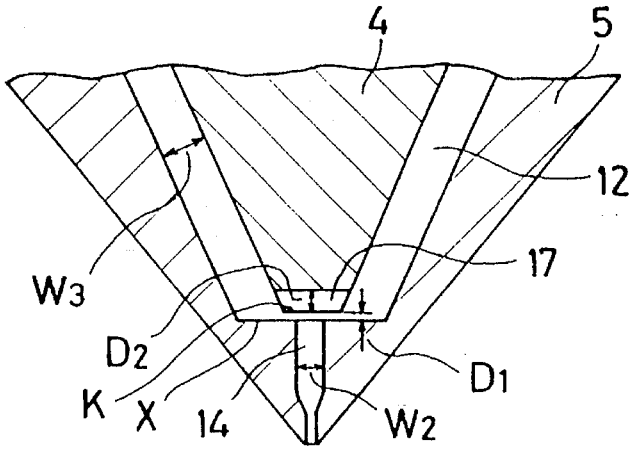
FIG. 2 shows an enlarged, cross-sectional view of the lower part of the nozzle plate of FIG. 1.

The above grooves 12 for controlling the pressure of the spinning resins refer to a clearance between the side wall of a nearly V-form part at the lower part of the separating plate 4 and the side wall of the cavity of the nozzle plate 5, as shown in FIGS. 1 and 2. The width $W_3$ of the controlling grooves 12 is preferably about 0.5 to 10 mm. If the width is too small, the transfer speed of the spinning resins is too high, so that viscosity unevenness occurs and the pressure variation in the confluent groove occurs; hence the conjugate state is inferior. To the contrary, if the width is too large, the transfer speed of the spinning resin is too low, so that an extraordinary thermal decomposition, carbonization, etc. of the spinning resin occur.

The diameter $W_2$ of the conjugate component-introducing hole 14 bored in the nozzle plate 5 is preferably about 0.3 to 5 mm, and the diameter of the spinning nozzle is preferably about 0.1 to 1.5 mm. Further, the spinning nozzles are preferred to be bored at a pitch of about 0.5 to 10 mm.

The separating plate 4 is secured at its top part to the distributing plate 3 by bolts 11*a*. In the separating plate 4, confluent grooves 17 are engraved at the lower part of the plate, in a plurality of rows, in the direction intersecting the length direction, that is, in the direction from the right to the left as viewed in FIG. 1. Between the respective confluent grooves 17, there are formed confluent groove-partitioning walls 19, for example a shown in FIG. 3. The confluent grooves 17 are arranged to number the same as the spinning nozzles 15 on the central axis of the respective spinning nozzles 15. The grooves 12 for controlling the pressure of the spinning resins formed by the clearance between the separating plate 4 and the nozzle plate 5 are extended in the length direction of the nozzle plate. Although the spinning resins flowing down through the grooves 12 may cause a pressure unevenness (flow quantity unevenness in each spinning nozzle) over the length direction of the nozzle plate 5, which may cause conjugate ratio unevenness and uneven fineness, the confluent grooves 17 prevent such conjugate fineness unevenness from occurring.

The depth $D_2$ of the confluent grooves (see FIG. 3) is preferably about 0.1 to 5 mm and the width $W_1$ thereof is preferably about 0.3 to 5 mm. Further, the width $W_1$ of the confluent grooves 17 is preferred to be the same as the diameter $W_2$ of the conjugate component-introducing holes, but either of $W_1>W_2$ (see FIGS. 4 and 10) or $W_1<W_2$ (see FIG. 9) may be employed. However, the proportion of $W_1$ and $W_2$ is preferably limited to 2:1 to 1:2. If the proportion is too small or too large, the conjugate ratio becomes uneven.

Figure 11:
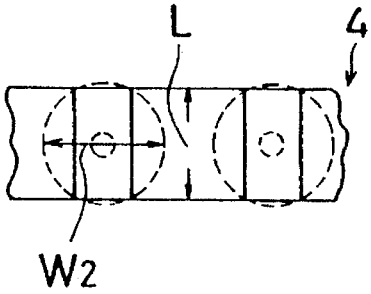
Figure 12:
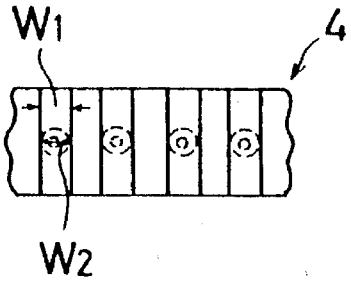
Figure 13:
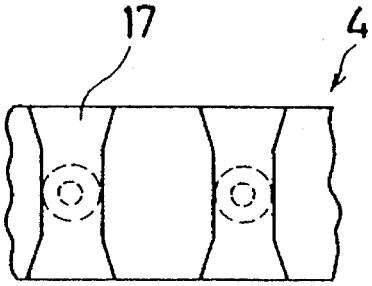

As to the relationship between the length L of the confluent grooves 17 and the diameter $W_2$ of the conjugate component-introducing hole 14, $L<W_2$ may be employed as shown in FIG. 11. The length L is preferred to be longer as far as the processing is possible. Further, as to the confluent grooves 17, the spinning resin-introducing inlet part thereof may be broader than the center part thereof, as shown in FIG. 13.

When an introducing groove 20 (see FIG. 6) is provided along with the confluent grooves 17, it is possible to more effectively prevent the conjugate ratio and the fineness unevenness from occurring. The width and the depth of the introducing groove 20 may be formed to the same extent as the width of the confluent grooves 17, and the depth and the length thereof may be formed to an extend to 2 to 30 mm. This introducing groove 20 may be extended from both the end parts of the confluent grooves 17 upward of the wall of the separating plate, as shown in FIGS. 5 and 6. The groove 20 is not limited to the vicinity of the lower part of the separating plate 4, but it may be engraved extending as far as the spinning resin-receiving grooves 13, for example.

It is easy to provide the separating plate 4, with the confluent grooves 17 by engraving, and at a low cost. Hence, it is possible to provide several separating plates each being different in the dimensions of the confluent grooves 17, exchange only the separating plate 4 without exchanging an expensive nozzle plate 5, and carry out trial spinning to select a separating plate affording an optimum conjugate state corresponding to the respective spinning resins.

In the present spinneret device, the bottom surface K of the confluent groove-partitioning wall 19 of the separating plate 4 may be contacted closely to the bottom surface X of the cavity of the nozzle plate 5, as shown in FIG. 7, but a narrow clearance $D_1$ may be provided between K and X, as shown in FIG. 3. When the bottom surface (K) is contacted closely to the bottom surface X ($D_1$=0), it is advantageous for separating the respective spinning nozzles, but liable to injure the bottom surface K and the bottom surface X, and since these bottom surfaces are close to the spinning nozzles, the injuries of these surfaces have a large influence upon the flow of the spinning resins, thereby causing nonuniformity of the fineness of the fibers. In the case of providing the narrow clearance $D_1$, $D_1$ is preferred to be smaller than the width $W_3$ of the grooves for controlling the pressure of the spinning resins. Further, $D_1$ is preferred to be smaller than either of $W_3$ and $D_2$ (see FIGS. 1 and 2). If $D_1$ is larger than $W_3$, a high pressure is applied onto the bottom part of the cavity of the nozzle plate (the inlet of the conjugate component-introducing hole 14), and a large pressure drop is thus liable to occur at the part, resulting in variation of the conjugate ratio and uneven fineness of fibers.

When spinning is carried out using the spinneret device of the present invention, two kinds of spinning resins are combined uniformly in side-by-side form in the respective confluent grooves arranged just above the spinning nozzles 15, pass through the conjugate component-introducing holes 14 and are led to the spinning nozzles 15. Thus, when the viscosity difference between two kinds of the components is relatively large, or even when the viscosity unevenness, the spinning temperature unevenness, etc. occur to a certain extent in the cavity part of the nozzle plate 5, microfine fibers can be obtained which are uniform in the conjugate ratio, the cross-sectional, peripheral percentages of the respective components in the fiber cross-section, etc. and yet uniformly fine.

The unstretched fibers extruded from the spinning nozzles 15 are stretched and at the same time cut into short fiber form, by spouting a high temperature and high pressure gas introduced from the gas-introducing hole 18 through a clearance 16 for gas spouting, followed by being collected in the form of a microfine fiber web by a collecting means arranged below the nozzle plate 15. As the spouting gas, and inert gas such as air, nitrogen gas, etc. is used, at a temperature of about 100° to 500° C. and pressure of about 0.5 to 6 Kg/cm$^2$. Further, the clearance 16 for the gas spouting may be arranged not only in one way as shown in FIG. 1, but also in two ways.

The cross-section of the thus obtained microfine fiber is typically shown in the form of a side-by-side type as shown by (26) and (27) in FIGS. 16(*a*) and 16(*b*). The fibers are used for various applications, as they are, or by subjecting them to modification treatment such as corona discharge treatment, hydrophilic nature-affording treatment, treatment with an anti-fungas agent, etc. or by blending them with other fibers, or in the form of a web or a non-woven fabric obtained by developing crimp by heating and/or by hot-melt adhesion of conjugate components of the fibers.

According to the spinneret device for conjugate melt-blow spinning of the present invention (items 1 to 3), since confluent grooves 17 are provided corresponding to the respective spinning nozzle 15 at the lower part of the separating plate 4, even when the viscosity unevenness, spinning temperature unevenness, etc. of the spinning resins occur to some extent at the cavity apart of the nozzle plate 5, microfine fibers can be obtained which are uniform in the composite ratio and the cross-sectional, peripheral percentages of the respective components in the fiber cross-section, and yet uniformly fine. Further, the separating plate 4 are easily engraved with the confluent grooves at a low cost.

Hence, it is possible to provide several separating plates each being different in the dimensions of the confluent grooves, carry out trial spinning and easily arrange a separate plate affording the optimum conjugate state corresponding to the respective spinning resins. It is also possible to arrange a nozzle plate having a broad width and a superior productivity. Further, according to the present invention of items 4 and 5, a device wherein the separating plate 4 and the nozzle plate 5 are arranged in a narrow clearance $D_1$, has an effectiveness that, in addition to the above effectiveness, either of the bottom of the nozzle plate 5 and the lower part of the separating plate 4 are not damaged, so that the life of the device can be prolonged.

What we claim is:

1. A spinneret device for side-by-side conjugate melt-blow spinning, comprising:

a spinning resin-feeding plate having respective resin-introducing grooves for introducing two kinds of spinning resins;

a distributing plate attached to the spinning resin-feeding plate and having first and second major surfaces, wherein said first major surfaces abuts a major surface of the spinning resin-feeding plate, said distributing plate having distributing grooves for receiving the spinning resins fed from the resin-introducing grooves of the spinning-resin-feeding plate and having distributing through holes communicating with said distributing grooves, said distributing holes extending between the distributing grooves and the second major surface of the distributing plate;

a nozzle plate fixed to the distributing plate having a plurality of spinning nozzles and having a first surface abutting the second major surface of the distributing plate, said nozzle plate having a cavity that receives a separating plate therein with clearances formed between the separating plate and nozzle plate providing pressure controlling grooves that receive the spinning resins from the distributing through holes, and said nozzle plate further having a plurality of conjugate holes formed in an interior surface of a portion of the nozzle plate extending toward said spinning nozzles, said conjugate holes opening towards confluent grooves wherein each of said conjugate holes respectively communicates with a corresponding one of said plurality of said spinning nozzles formed in a downwardly-extending portion of the nozzle plate, and wherein said spinning nozzles open away from the cavity;

said separating plate being attached to the second major surface of the distributing plate and having said confluent grooves at a bottom portion thereof facing the plurality of conjugate holes of the nozzle plate, for combining the different spinning resins before introduction thereof into the plurality of conjugate holes, wherein each of the confluent grooves extends in a direction that intersects with a central axis defined by one of the spinning nozzles;

a clearance-defining plate having a V-shaped groove receiving the downwardly-extending portion of the nozzle plate therein, said clearance-defining plate being arranged to provide a gas-introducing clearance between the nozzle plate and the clearance-defining plate for stretching the combined resins using a gas introduced in said clearance as the combined resins emerge from the spinning nozzles;

wherein the confluent grooves of the separating plate are respectively located such that the separating plate forms partitioning walls between adjacent confluent grooves; and wherein the partitioning walls have bottom surfaces that are separated from the interior surface of the nozzle plate by a distance $D_1$ that is smaller than a width $W_3$ of said respective pressure-controlling grooves extending between the second major surface of the distributing plate and the confluent grooves of the separating plate, said pressure-controlling grooves being defined by a separation between the separating plate and the nozzle plate.

2. A spinneret device for side-by-side conjugate melt-blow spinning, comprising:

a spinning resin-feeding plate having respective resin-introducing grooves for introducing two kinds of spinning resins;

a distributing plate attached to the spinning resin-feeding plate and having first and second major surfaces, wherein said first major surface abuts a major surface of the spinning resin-feeding plate, said distributing plate having distributing grooves for receiving the spinning resins fed from the resin-introducing grooves of the spinning resin-feeding plate and having distributing through holes communicating with said distributing grooves, said distributing holes extending between the distributing grooves and the second major surface of the distributing plate;

a nozzle plate fixed to the distributing plate having a plurality of spinning nozzles and having a first surface abutting the second major surface of the distributing plate, said nozzle plate having a cavity that receives a separating plate therein with clearances formed between the separating plate and nozzle plate providing pressure controlling grooves that receive the spinning resins from the distributing through holes, and said nozzle plate further having a plurality of conjugate holes formed in an interior surface of a portion of the nozzle plate extending toward said spinning nozzles, said conjugate holes opening towards confluent grooves wherein each of said conjugate holes respectively communicates with a corresponding one of said plurality of said spinning nozzles formed in a downwardly-extending portion of the nozzle plate, and wherein said spinning nozzles open away from the cavity;

said separating plate being attached to the second major surface of the distributing plate and having said confluent grooves at a bottom portion thereof facing the plurality of conjugate holes of the nozzle plate, for combining the different spinning resins before introduction thereof into the plurality of conjugate holes, wherein each of the confluent grooves extends in a direction that intersects with a central axis defined by one of the spinning nozzles;

a clearance-defining plate having a V-shaped groove for receiving the downwardly-extending portion of the nozzle plate therein, said clearance-defining plate being arranged to provide a gas-introducing clearance between the nozzle plate and the clearance-defining plate for stretching the combined resins using a gas introduced in said clearance as the combined resins emerge from the spinning nozzles;

wherein the confluent grooves of the separating plate are respectively located such that the separating plate forms partitioning walls between adjacent confluent grooves; and wherein the partitioning walls have bottom surfaces that are separated from the interior surface of the nozzle plate by a distance $D_1$ that is smaller than a depth $D_2$ of the confluent grooves.

3. A spinneret device according to claim 2, wherein the depth $D_2$ is smaller than a width $W_3$ of said respective pressure-controlling grooves extending between the second major surface of the distributing plate and the confluent grooves of the separating plate, said pressure-controlling grooves being defined by a separation between the separating plate and the nozzle plate.

* * * * *